US006385979B2

(12) United States Patent
Ota et al.

(10) Patent No.: US 6,385,979 B2
(45) Date of Patent: May 14, 2002

(54) DISPLACEMENT CONTROL APPARATUS AND METHOD FOR VARIABLE DISPLACEMENT COMPRESSOR

(75) Inventors: Masaki Ota; Kazuya Kimura; Masahiro Kawaguchi; Ken Suitou; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/745,092

(22) Filed: Dec. 20, 2000

(30) Foreign Application Priority Data

Dec. 24, 1999 (JP) ..... 11-368009

(51) Int. Cl.[7] ..... B60H 1/32; F25B 1/00

(52) U.S. Cl. ..... 62/115; 62/209; 62/228.3; 62/133

(58) Field of Search ..... 62/133, 209, 228.3, 62/229

(56) References Cited

U.S. PATENT DOCUMENTS 5,823,000 A * 10/1998 Taki ..... 62/133
5,924,296 A * 7/1999 Takano et al. ..... 62/133
6,321,545 B1 * 11/2001 Ota et al. ..... 6/228.3

FOREIGN PATENT DOCUMENTS

JP 5-58151 3/1993

* cited by examiner

*Primary Examiner*—William Wayner
(74) *Attorney, Agent, or Firm*—Morgan & Finnegan, LLP

(57) ABSTRACT

A control valve is located in a variable displacement compressor used in a refrigerant circuit. The control valve operates such that the pressure difference between two pressure monitoring points in the refrigerant circuit seeks a predetermined target value. A controller determines the target value of the pressure difference in accordance with external information that represents the required cooling performance. The target value of the pressure difference is represented by a duty ratio applied to the control valve. When the acceleration pedal is pressed beyond a predetermined level, the controller limits the duty ratio. Therefore, the compressor torque does not hinder quick vehicle acceleration. Also, the cooling performance is not lowered unless it is necessary.

16 Claims, 8 Drawing Sheets

DISPLACEMENT CONTROL APPARATUS AND METHOD FOR VARIABLE DISPLACEMENT COMPRESSOR

BACKGROUND OF THE INVENTION

The present invention relates to a variable displacement compressor used in a refrigerant circuit of a vehicle air conditioner. More particularly, the present invention pertains to a displacement control apparatus and a displacement control method for the variable displacement compressor.

A typical refrigerant circuit of a vehicle air conditioner includes a condenser, an expansion valve, an evaporator and a compressor. The compressor receives refrigerant gas from the evaporator. The compressor then compresses the gas and discharges the gas to the condenser. The evaporator transfers heat to the refrigerant in the refrigerant circuit from the air in the passenger compartment. The pressure of refrigerant gas at the outlet of the evaporator, in other words, the pressure of refrigerant gas that is drawn into the compressor (suction pressure Ps), represents the thermal load on the refrigerant circuit.

Variable displacement swash plate type compressors are widely used in vehicles. Such compressors include a displacement control valve that operates to maintain the suction pressure Ps at a predetermined target level (target suction pressure). The control valve changes the inclination angle of the swash plate in accordance with the suction pressure Ps for controlling the displacement of the compressor. The control valve includes a valve body and a pressure sensing member such as a bellows or a diaphragm. The pressure sensing member moves the valve body in accordance with the suction pressure Ps, which adjusts the pressure in a crank chamber. The inclination of the swash plate is adjusted, accordingly.

In addition to the above structure, some control valves include an electromagnetic actuator, such as a solenoid, to change the target suction pressure. An electromagnetic actuator urges a pressure sensing member or a valve body in one direction by a force that corresponds to the value of an externally supplied current. The magnitude of the force determines the target suction pressure. Varying the target suction pressure permits the air conditioning to be finely controlled.

Such compressors are usually driven by vehicle engines. Among the auxiliary devices of a vehicle, the compressor consumes the most engine power and is therefore a great load on the engine. When the load on the engine is great, for example, when the vehicle is accelerating or moving uphill, all available engine power needs to be used for moving the vehicle. Under such conditions, to reduce the engine load, the compressor displacement is minimized. This will be referred to as a displacement limiting control procedure. A compressor having a control valve that changes a target suction pressure raises the target suction pressure when executing the displacement limiting control procedure. Then, the compressor displacement is decreased such that the actual suction pressure Ps is increased to approach the target suction pressure.

The graph of FIG. 8 illustrates the relationship between suction pressure Ps and displacement Vc of a compressor. The relationship is represented by multiple lines in accordance with the thermal load in an evaporator. Thus, if the suction pressure Ps is constant, the compressor displacement Vc increases as the thermal load increases. If a level Psl is set as a target suction pressure, the actual displacement Vc varies in a certain range (ΔVc in FIG. 8) due to the thermal load. If a high thermal load is applied to the evaporator during the displacement limiting control procedure, an increase of the target suction pressure does not lower the compressor displacement Vc to a level that sufficiently reduces the engine load.

Thus, the compressor displacement is not always controlled as desired as long as the displacement is controlled based on the suction pressure Ps.

SUMMARY OF THE INVENTION

Accordingly, it is an objective of the present invention to provide a displacement control apparatus and a displacement control method for a variable displacement compressor that accurately controls the compressor displacement regardless of the thermal load on an evaporator.

To achieve the above objective, the present invention provides a displacement control apparatus for a variable displacement compressor used in a refrigerant circuit of a vehicle air conditioner. The compressor is driven by a drive source of a vehicle. The apparatus includes a displacement control apparatus, a first device, a second device and a controller. The displacement control mechanism controls the displacement of the compressor based on the pressure difference between the pressures at two pressure monitoring points located in the refrigerant circuit. The pressure difference represents the displacement of the compressor. The first device detects external information representing the required cooling performance of the refrigerant circuit. The second device detects external information representing the load acting on the drive source. The controller determines a target value of the pressure difference based on the external information detected by the first device. The displacement control mechanism controls the displacement of the compressor such that the pressure difference seeks the target value and judges whether to set a limit value of the pressure difference based on the external information detected by the second device. When the limit value is set and a compressor displacement that corresponds to the target value is greater than a compressor displacement that corresponds to the limit value, the controller uses the limit value as the target value of the pressure difference to limit the compressor displacement.

The present invention may also be embodied in a method for controlling the displacement of a variable displacement compressor used in a refrigerant circuit of a vehicle air conditioner. The compressor is driven by a drive source of a vehicle. The method includes determining a target value of the pressure difference between the pressures at two pressure monitoring points located in the refrigerant circuit based on external information that represents the required cooling performance of the refrigerant circuit, the pressure difference representing the displacement of the compressor, controlling the compressor displacement such that the pressure difference seeks the target value, judging whether to set a limit value of the pressure difference based on external information that represents the load acting on the drive source, and using the limit value as the target value of the pressure difference when the limit value is set and when a compressor displacement that corresponds to the target value is greater than a compressor displacement that corresponds to the limit value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
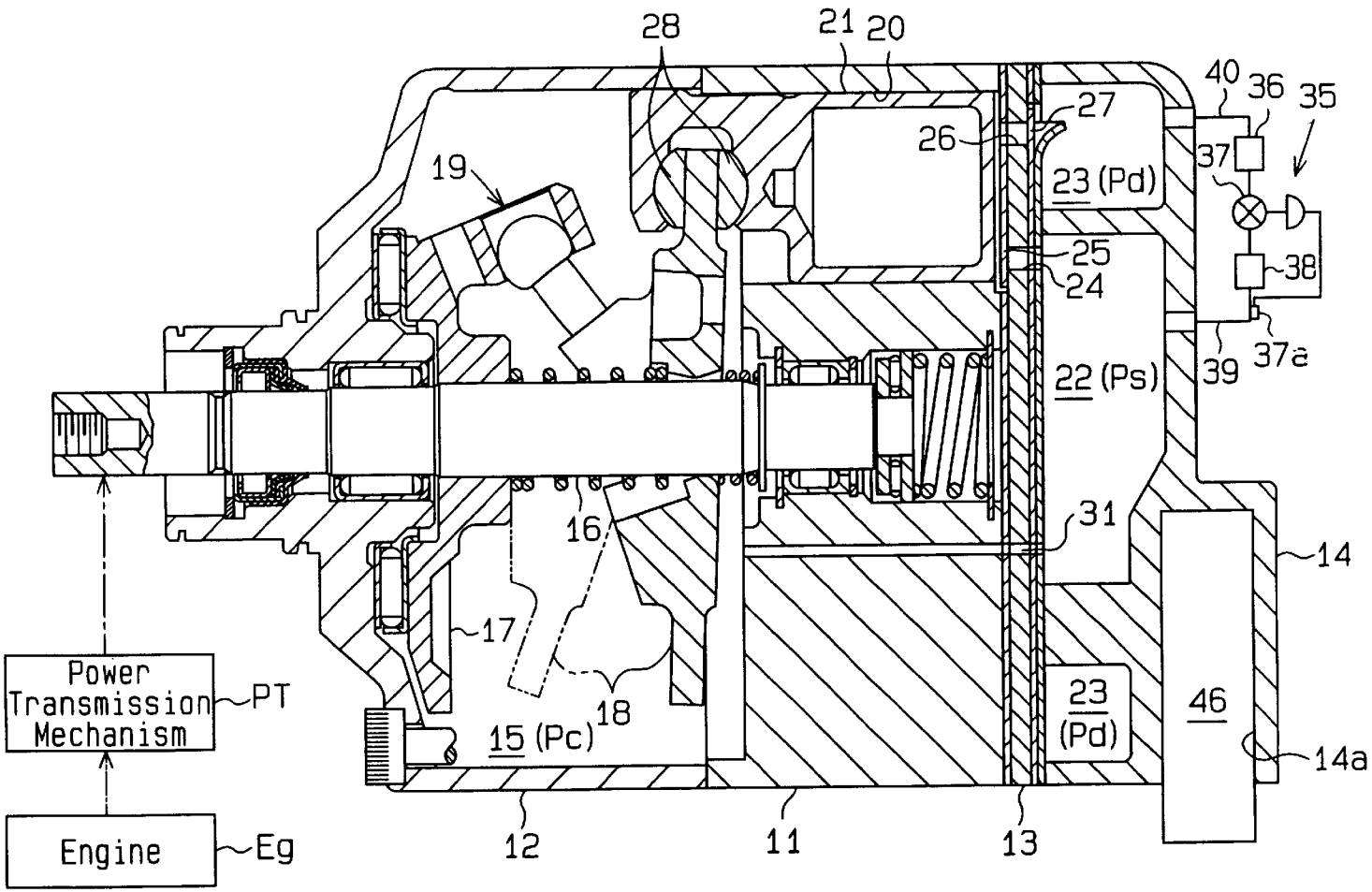
FIG. 1 is a cross-sectional view illustrating a variable displacement swash plate type compressor according to one embodiment of the present invention.

One embodiment of the present invention will now be described with reference to FIGS. 1 to 7. As shown in FIG. 1, a variable displacement swash plate type compressor used in a vehicle includes a cylinder block 11, a front housing member 12, which is secured to the front end face of the cylinder block 11, and a rear housing member 14, which is secured to the rear end face of the cylinder block 11. A valve plate assembly 13 is located between the cylinder block 11 and the rear housing member 14. In FIG. 1, the left end of the compressor is defined as the front end, and the right end of the compressor is defined as the rear end.

A crank chamber 15 is defined between the cylinder block 11 and the front housing member 12. A drive shaft 16 extends through the crank chamber 15 and is supported by the cylinder block 11 and a front housing member 12.

The front end of the drive shaft 16 is connected to an external drive source, which is an internal combustion engine Eg used in a vehicle in this embodiment, through a power transmission mechanism PT. The power transmission mechanism PT includes a belt and a pulley. The mechanism PT may be a clutch mechanism, such as an electromagnetic clutch, which is electrically controlled from the outside. In this embodiment, the mechanism PT has no clutch mechanism. Thus, when the engine Eg is running, the compressor is driven continuously.

A lug plate 17 is secured to the drive shaft 16 in the crank chamber 15. A drive plate, which is a swash plate 18 in this embodiment, is accommodated in the crank chamber 15. The swash plate 18 has a hole formed in the center. The drive shaft 16 extends through the hole in the swash plate 18. The swash plate 18 is coupled to the lug plate 17 by a hinge mechanism 19. The hinge mechanism 19 permits the swash plate 18 to rotate integrally with the lug plate 17 and drive shaft 16. The hinge mechanism 19 also permits the swash plate 18 to slide along the drive shaft 16 and to tilt with respect to a plane perpendicular to the axis of the drive shaft 16.

Several cylinder bores 20 (only one shown) are formed about the axis of the drive shaft 16 in the cylinder block 11. A single headed piston 21 is accommodated in each cylinder bore 20. Each piston 21 and the corresponding cylinder bore 20 define a compression chamber. Each piston 21 is coupled to the swash plate 18 by a pair of shoes 28. The swash plate 18 coverts rotation of the drive shaft 16 into reciprocation of each piston 21.

A suction chamber 22 and a discharge chamber 23 are defined between the valve plate assembly 13 and the rear housing member 14. The suction chamber 22 forms a suction pressure zone, the pressure of which is a suction pressure Ps. The discharge chamber 23 forms a discharge pressure zone, the pressure of which is a discharge pressure Pd. The valve plate assembly 13 has suction ports 24, suction valve flaps 25, discharge ports 26 and discharge valve flaps 27. Each set of the suction port 24, the suction valve flap 25, the discharge port 26 and the discharge valve flap 27 corresponds to one of the cylinder bores 20. When each piston 21 moves from the top dead center position to the bottom dead center position, refrigerant gas in the suction chamber 22 flows into the corresponding cylinder bore 20 via the corresponding suction port 24 and suction valve 25. When each piston 21 moves from the bottom dead center position to the top dead center position, refrigerant gas in the corresponding cylinder bore 20 is compressed to a predetermined pressure and is discharged to the discharge chamber 23 via the corresponding discharge port 26 and discharge valve 27.

The inclination angle of the swash plate 18 is determined according to the pressure in the crank chamber 15 (crank pressure Pc). The inclination angle of the swash plate 18 defines the stroke of each piston 21 and the displacement of the compressor.

Figure 2:
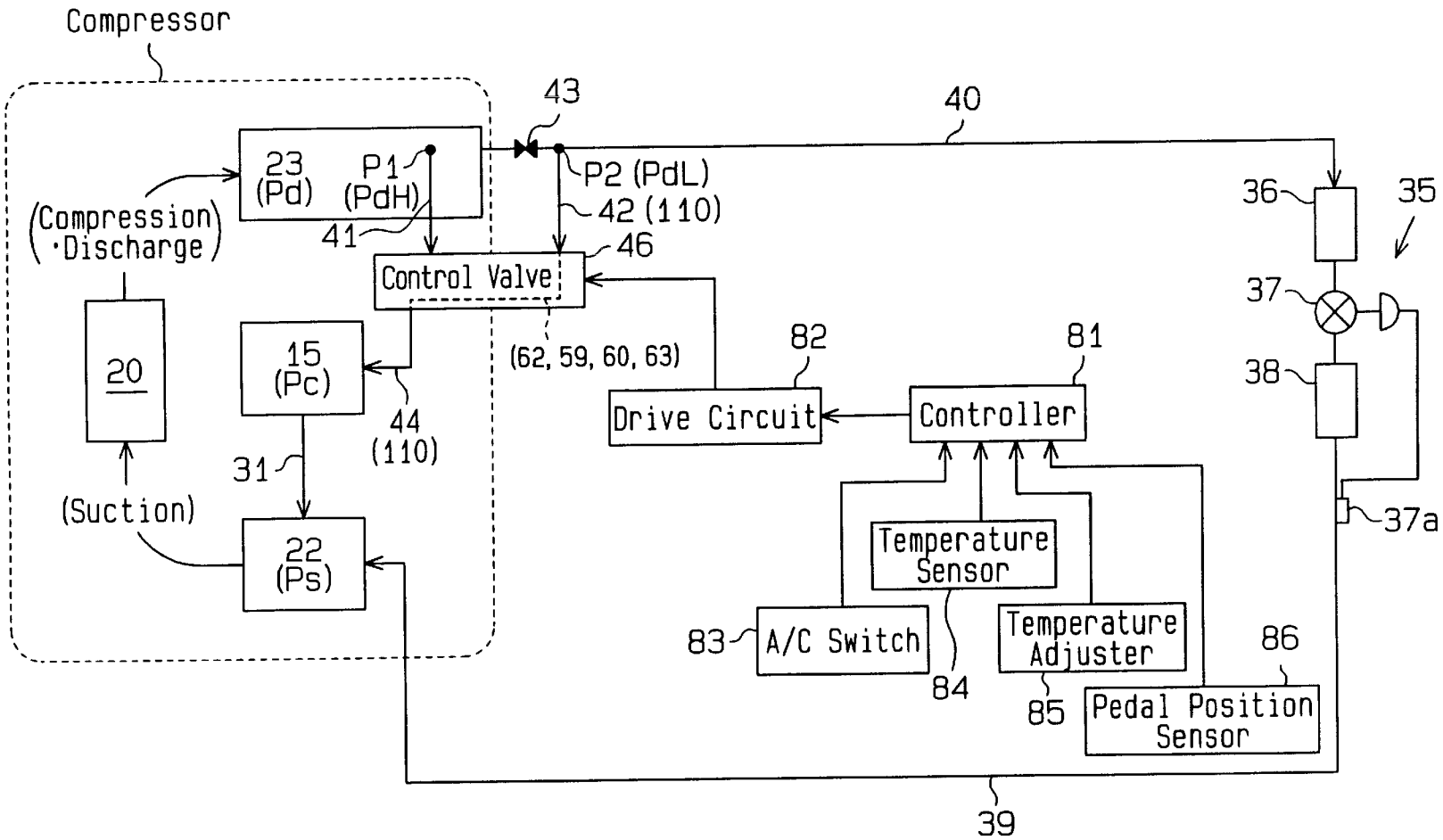
FIG. 2 is a schematic diagram illustrating a refrigerant circuit including the compressor of FIG. 1.

As shown in FIGS. 1 and 2, the refrigerant circuit of the vehicle air conditioner includes the compressor and an external circuit 35, which is connected to the compressor. The external circuit 35 includes a condenser 36, a temperature-type expansion valve 37 and an evaporator 38. The expansion valve 37 adjusts the flow rate of refrigerant supplied to the evaporator 38 based on the temperature or the pressure detected by a heat sensitive tube 37*a,* which is located downstream of the evaporator 38. The temperature or the pressure at the downstream of the evaporator 38 represents the thermal load on the evaporator 38. The external circuit 35 includes a low pressure pipe 39, which extends from the evaporator 38 to the suction chamber 22 of the compressor, and a high pressure pipe 40, which extends from the discharge chamber 23 of the compressor to the condenser 36.

The flow rate of the refrigerant in the refrigerant circuit is expressed by the product of the amount of the refrigerant gas discharged from the compressor during one rotation of the drive shaft 16 multiplied by the rotational speed of the drive shaft 16. The speed of the drive shaft 16 is computed based on the speed of the engine Eg and the ratio of the speed of the drive shaft 16 to the speed of the engine Eg. The speed ratio is determined by the power transmission mechanism PT. Under the condition where the engine Eg rotates at a constant rotational speed, the flow rate of the refrigerant in the refrigerant circuit increases as the compressor displacement increases when the inclination angle of the swash plate 18 increases. In other words, when the inclination angle of the swash plate 18 or the compressor displacement is constant, the flow rate of the refrigerant in the refrigerant circuit increases as the rotational speed of the engine Eg increases.

Pressure loss in the refrigerant circuit increases as the flow rate of the refrigerant in the refrigerant circuit increases. If an upstream first pressure monitoring point and a downstream second pressure monitoring point are set up in the refrigerant circuit, the pressure difference between these two points due to the pressure loss shows a positive correlation with the flow rate of the refrigerant in the refrigerant circuit. Thus, the flow rate of the refrigerant in the refrigerant circuit can be detected indirectly by detecting the difference between the refrigerant gas pressure at the first pressure monitoring point and that at the second pressure monitoring point. In this embodiment, a first pressure monitoring point P1 is set up in the discharge chamber 23 corresponding to the most upstream section in the high pressure pipe 40, and a second pressure monitoring point P2 is set up in the high pressure pipe 40 at a predetermined distance downstream from the first point P1, as shown in FIG. 2. The refrigerant gas pressure at the first pressure monitoring point P1 and that at the second pressure monitoring point P2 are hereinafter referred to as PdH and PdL, respectively.

The compressor has a crank pressure control mechanism for controlling the crank pressure Pc. As shown in FIGS. 1 and 2, the crank pressure control mechanism includes a bleed passage 31, a first pressure introduction passage 41, a second pressure introduction passage 42, a crank passage 44 and a control valve 46. The bleed passage 31 connects the crank chamber 15 to the suction chamber 22 to conduct refrigerant gas from the crank chamber 15 to the suction chamber 22. The first pressure introduction passage 41 connects the discharge chamber 23, i.e., the first pressure monitoring point P1, to the control valve 46. The second pressure introduction passage 42 connects the second pressure monitoring point P2 to the control valve 46. The crank passage 44 connects the control valve 46 to the crank chamber 15.

The second pressure introduction passage 42 and the crank passage 44 form a supply passage 110 for connecting the second pressure monitoring point P2 to the crank chamber 15. The second pressure introduction passage 42 forms an upstream section of the supply passage 110, and the crank passage 44 forms a downstream section of the supply passage 110. The control valve 46 adjusts the flow rate of the high pressure refrigerant gas supplied from the second pressure monitoring point P2, through the supply passage 110, to the crank chamber 15 to control the crank pressure Pc.

As shown in FIG. 2, the high pressure pipe 40 is provided with a fixed restrictor 43 between the first pressure monitoring point P1 and the second pressure monitoring point P2. The fixed restrictor 43 increases the pressure difference (PdH−PdL) between the two pressure monitoring points P1 and P2. This enables the distance between the two pressure monitoring points P1 and P2 to be reduced and permits the second pressure monitoring point P2 to be relatively close to the compressor. Thus, the second pressure introduction passage 42, which extends from the second pressure monitoring point P2 to the control valve 46 in the compressor, can be shortened.

Figure 3:
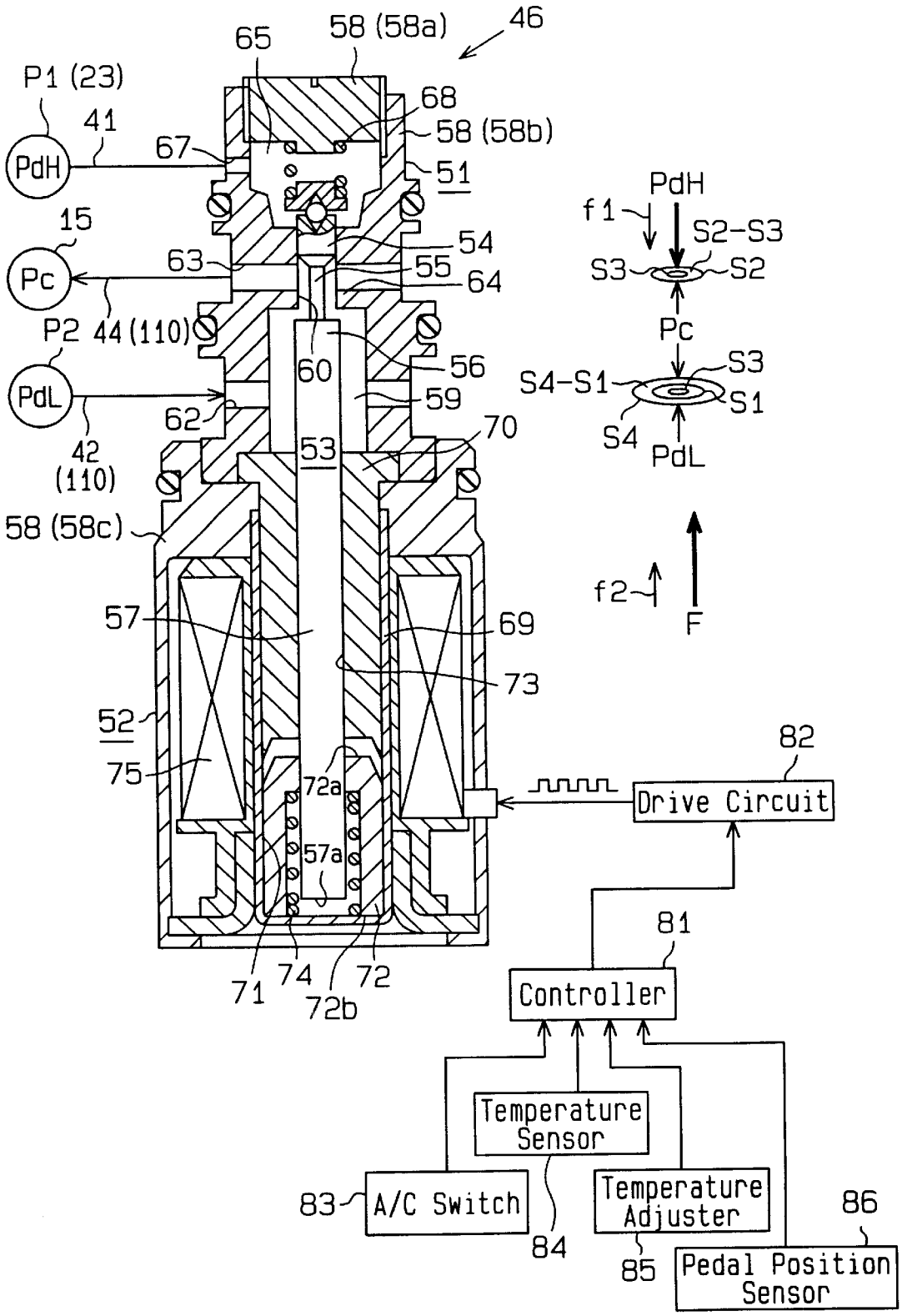
FIG. 3 is a cross-sectional view illustrating a control valve of FIG. 1.
Figure 4:
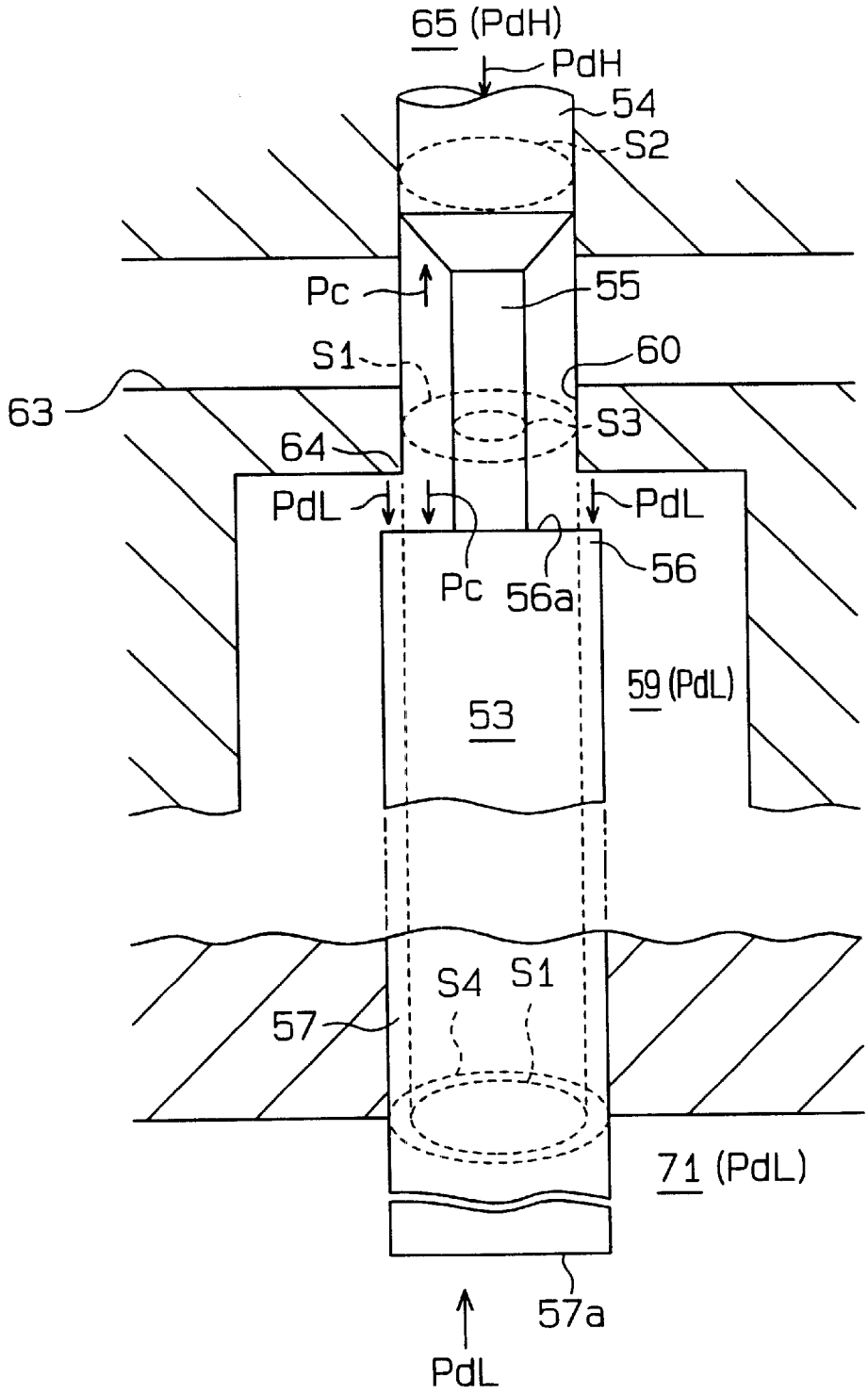
FIG. 4 is a schematic cross-sectional view showing part of the control valve shown in FIG. 3.

As shown in FIG. 1, the control valve 46 is fitted in a receiving hole 14*a* of the rear housing member 14. As shown in FIGS. 3 and 4, the control valve 46 is provided with an inlet valve mechanism 51 and a solenoid 52, which serves as an electromagnetic actuator. The inlet valve mechanism 51 adjusts the aperture of the supply passage 110. The solenoid 52 exerts a force according to the level of the electric current supplied from the outside to the inlet valve mechanism 51 through an operating rod 53. The operating rod 53 is cylindrical and has a divider 54, a coupler 55 and a guide 57. The part of the guide 57 adjacent to the coupler 55 functions as a valve body 56. The cross-sectional area S3 of the coupler 55 is smaller than the cross-sectional area S4 of the guide 57 and the valve body 56.

The control valve 46 has a valve housing 58 containing an upper housing member 58*b* and a lower housing member 58*c*. The upper housing member 58*b* constitutes a shell for the inlet valve mechanism 51, and the lower housing member 58*c* constitutes a shell for the solenoid 52. A plug 58*a* is screwed into the upper housing member 58*b* to close an opening in its upper end. A valve chamber 59 and a through hole 60 connected thereto are defined in the upper housing member 58*b*. The upper housing member 58*b* and the plug 58*a* define a high pressure chamber 65 as a first pressure chamber. The high pressure chamber 65 and the valve chamber 59 communicate with each other through the through hole 60. The operating rod 53 extends through the valve chamber 59, the through hole 60 and the high pressure chamber 65. The operating rod 53 moves axially such that the valve body 56 selectively connects and blocks off the valve chamber 59 with respect to the through hole 60.

A first radial port 62 is formed in the upper housing member 58*b* to communicate with the valve chamber 59. The valve chamber 59 is connected to the second pressure monitoring point P2 through the first port 62 and the second pressure introduction passage 42. Thus, the pressure PdL at the second pressure monitoring point P2 exerts to the inside of the valve chamber 59 through the second pressure introduction passage 42 and the first port 62. A second port 63 extending radially is formed in the upper housing member 58*b* to communicate with the through hole 60. The through hole 60 is connected to the crank chamber 15 through the second port 63 and the crank passage 44. When the valve body 56 opens to connect the valve chamber 59 to the through hole 60, the refrigerant gas is supplied from the second pressure monitoring point P2, through the supply passage 110, which includes the second pressure introduction passage 42 and the crank passage 44, into the crank chamber 15. The ports 62 and 63, the valve chamber 59 and the through hole 60 constitute a part of the supply passage 110 within the control valve 46.

The valve body 56 is located in the valve chamber 59. The cross-sectional area S3 of the coupler 55 is less than the cross-sectional area S1 of the through hole 60. The cross-sectional area S1 of the through hole 60 is less than the cross-sectional area S4 of the valve body 56. The inner wall of the valve chamber 59, to which the through hole 60 opens, functions as a valve seat 64 for receiving the valve body 56. The through hole 60 functions as a valve opening, which is opened and closed selectively by the valve body 56. When the valve body 56 is abutted against the valve seat 64, the through hole 60 is shut off from the valve chamber 59. As shown in FIG. 3, when the valve body 56 is spaced from the valve seat 64, the through hole 60 is connected to the valve chamber 59.

The divider 54 of the operating rod 53 has a portion located in the through hole 60 and a portion located in the high pressure chamber 65. The cross-sectional area S2 of the divider 54 is equal to the cross-sectional area S1 of the through hole 60. Therefore, the divider 54 shuts off the high pressure chamber 65 from the valve chamber 59.

A third radial port 67 is defined in the upper housing member 58*b* to communicate with the high pressure chamber 65. The high pressure chamber 65 is connected through the third port 67 and the first pressure introduction passage 41 to the first pressure monitoring point P1 or the discharge chamber 23. Thus, the pressure PdH at the first pressure monitoring point P1 is exerted through the first pressure introduction passage 41 and the third port 67 to the high pressure chamber 65.

A return spring 68 is contained in the high pressure chamber 65. The return spring 68 urges the operating rod 53 to cause the valve body 56 to move away from the valve seat 64.

The solenoid 52 is provided with a cup-shaped receiving cylinder 69, which is fixed in the lower housing member 58*c*. A fixed iron core 70 is fitted in the upper opening of the receiving cylinder 69. The fixed iron core 70 constitutes a part of the inner wall of the valve chamber 59 and also defines a plunger chamber 71, which serves as a second pressure chamber. A plunger 72 is located in the plunger chamber 71. The fixed iron core 70 includes a guide hole 73, which accommodates the guide 57 of the operating rod 53. A slight clearance (not shown) exists between the inner wall of the guide hole 73 and the guide 57. The valve chamber 59 and the plunger chamber 71 communicate normally with each other through the clearance. Thus, the pressure in the valve chamber 59, or the pressure PdL at the second pressure monitoring point P2, is applied inside the plunger chamber 71.

The lower end of the guide 57 extends into the plunger chamber 71. The plunger 72 is fixed to the lower end of the guide 57. The plunger 72 moves in the axial direction integrally with the operating rod 53. A shock absorbing spring 74 is contained in the plunger chamber 71 to urge the plunger 72 toward the fixed iron core 70.

A coil 75 surrounds the fixed iron core 70 and the plunger 72. A controller 81 supplies electric power to the coil 75 through a drive circuit 82. The coil 75 then generates an electromagnetic force F between the fixed iron core 70 and the plunger 72 corresponding to the level of the electric power supplied to the coil 75. The electromagnetic force F attracts the plunger 72 toward the fixed iron core 70 and urges the operating rod 53 to cause the valve body 56 to move toward the valve seat 64.

The force of the shock absorbing spring 74 is smaller than the force of the return spring 68. Therefore, the return spring 68 moves the plunger 72 and the operating rod 53 to the initial position as shown in FIG. 3 when no power is supplied to the coil 75, and the valve body 56 is moved to the lowest position to maximize the opening size of the through hole 60.

There are methods for changing voltage applied to the coil 75, one of which is to change the voltage value and another is referred to as PWM control or duty control. Duty control is employed in this embodiment. Duty control is a method where the ON-time per cycle of a pulsed voltage, which is turned on and off periodically, is adjusted to modify the average value of the voltage applied. An average applied voltage value can be obtained by multiplying the value obtained by dividing the ON-time of the pulsed voltage by the cycle time thereof, i.e., the duty ratio Dt, by the pulsed voltage value. In duty control, the electric current varies intermittently. This reduces hysteresis of the solenoid 52. The smaller the duty ratio Dt is, the smaller the electromagnetic force F generated between the fixed iron core 70 and the plunger 72 is and the greater the opening size of the through hole 60 by the valve body 56 is. It is also possible to measure the value of the electric current flowing through the coil 75 and perform feed back control of the value of the voltage applied to the coil 75.

The opening size of the through hole 60 by the valve body 56 depends on the axial position of the operating rod 53. The axial position of the operating rod 53 is determined based on various forces that act axially on the operating rod 53. These forces will be described referring to FIGS. 3 and 4. The downward forces in FIGS. 3 and 4 tend to space the valve body 56 from the valve seat 64 (the valve opening direction). The upward forces in FIGS. 3 and 4 tend to move the valve body 56 toward the valve seat 64 (the valve closing direction).

First, the various forces acting on the portion of the operating rod 53 above the coupler 55, i.e., on the divider 54, will be described. As shown in FIGS. 3 and 4, the divider 54 receives a downward force f1 from the return spring 68. The divider 54 also receives a downward force based on the pressure PdH in the high pressure chamber 65. The effective pressure receiving area of the divider 54 with respect to the pressure PdH in the high pressure chamber 65 is equal to the cross-sectional area S2 of the divider 54. The divider 54 also receives an upward force based on the pressure in the through hole 60 (crank pressure Pc). The effective pressure receiving area of the divider 54 with respect to the pressure in the through hole 60 is equal to the cross-sectional area S2 of the divider 54 minus the cross-sectional area S3 of the coupler 55. Provided that the downward forces are positive values, the net force ΣF1 acting upon the divider 54 can be expressed by the following equation I.

$$\Sigma F1 = PdH \cdot S2 - Pc(S2 - S3) + f1 \qquad \text{Equation I}$$

Next, various forces that act upon the portion of the operating rod 53 below the coupler 55, i.e., on the guide 57, will be described. The guide 57 receives an upward force f2 from the shock absorbing spring 74 and an upward electromagnetic force F from the plunger 72. Further, as shown in FIG. 4, the end face 56*a* of the valve body 56 is divided into a radially inner portion and a radially outer portion by an imaginary cylinder, which is shown by broken lines in FIG. 4. The imaginary cylinder corresponds to the wall defining the through hole 60. The pressure receiving area of the radially inner portion is expressed by S1−S3, and that of the radially outer portion is expressed by S4−S1. The radially inner portion receives a downward force based on the pressure in the through hole 60 (crank pressure Pc). The radially outer portion receives a downward force based on the pressure PdL in the valve chamber 59.

As described above, the pressure PdL in the valve chamber 59 is applied to the plunger chamber 71. The upper surface 72*a* of the plunger 72 has a pressure receiving area that is equal to that of the lower surface 72*b* (see FIG. 3), and the forces that act on the plunger 72 based on the pressure PdL offset each other. However, the lower end face 57*a* of the guide 57 receives an upward force based on the pressure PdL in the plunger chamber 71. The effective pressure receiving area of the lower end face 57*a* is equal to the cross-sectional area S4 of the guide 57. Provided that the upward forces are positive values, the net force ΣF2 acting upon the guide 57 can be expressed by the following equation II.

$$\begin{aligned}\Sigma F2 &= F + f2 - Pc(S1 - S3) - PdL(S4 - S1) + PdL \cdot S4 \qquad \text{Equation II}\\ &= F + f2 + PdL \cdot S1 - Pc(S1 - S3)\end{aligned}$$

In the process of simplifying equation II, −PdL·S4 is canceled by +PdL·S4, and the term +PdL·S1 remains. Thus, the resultant of the downward force based on the pressure PdL acting upon the guide 57 and the upward force based on the pressure PdL acting upon the guide 57 is a net upward force, and the magnitude of this resultant force depends only on the cross-sectional area S1 of the through hole 60. The surface area of the portion of the guide 57 that receives the pressure PdL with effect, i.e., the effective pressure receiving area of the guide 57 with respect to the pressure PdL, is always equal to the cross-sectional area S1 of the through hole 60 regardless of the cross-sectional area S4 of the guide 57.

The axial position of the operating rod 53 is determined such that the force ΣF1 in the equation I and the force ΣF2 in the equation II are equal. When the force ΣF1 is equal to the force ΣF2 (ΣF1=ΣF2), the following equation III is satisfied.

$$PdH \cdot S2 - PdL \cdot S1 - Pc(S2 - S1) = F - f1 + f2 \quad \text{Equation III}$$

The cross-sectional area S1 of the through hole 60 is equal to the cross-sectional area S2 of the divider 54. Therefore, if S2 is replaced with S1 in equation III, the following equation IV is obtained.

$$PdH - PdL = (F - f1 + f2)/S1 \quad \text{Equation IV}$$

In equation IV, f1, f2 and S1 are determined by the design of the control valve 46. The electromagnetic force F is a variable parameter that changes depending on the power supplied to the coil 75. The equation IV shows that the operating rod 53 operates to change the pressure difference (PdH−PdL) in accordance with the change in the electromagnetic force F. In other words, the operating rod 53 operates in accordance with the pressure PdH and the pressure PdL, which act on the rod 53, such that the pressure difference (PdH−PdL) seeks a target value, which is determined by the electromagnetic force F. The operating rod 53 functions as a pressure detecting body or a pressure receiving body.

As shown in FIGS. 2 and 3, the controller 81 is a computer, which includes a CPU, a ROM, a RAM and an input-output interface. Several devices 83 to 86 detect various external information necessary for controlling the compressor and send the information to the controller 81. The devices 83 to 86 include an air conditioner switch 83, a passenger compartment temperature sensor 84, a temperature adjuster 85 for setting a desired temperature in the passenger compartment and a pedal position sensor 86 for detecting the depression degree of an acceleration pedal of the vehicle. Instead of or in addition to the pedal position sensor 86, the devices may include a throttle sensor for detecting the opening size of a throttle valve of the engine Eg. The temperature sensor 84 and the temperature adjuster 85 detect external information representing the required cooling performance of the refrigerant circuit. The depression degree of the acceleration pedal and the opening size of the throttle valve represent the load on the engine Eg.

The controller 81 computes an appropriate duty ratio Dt based on the information from the devices 83 to 86 and commands the drive circuit 82 to output a voltage having the computed duty ratio Dt. The drive circuit 82 outputs the instructed pulse voltage having the duty ratio Dt to the coil 75 of the control valve 46. The electromagnetic force F of the solenoid 52 is determined according to the duty ratio Dt.

Figure 5:
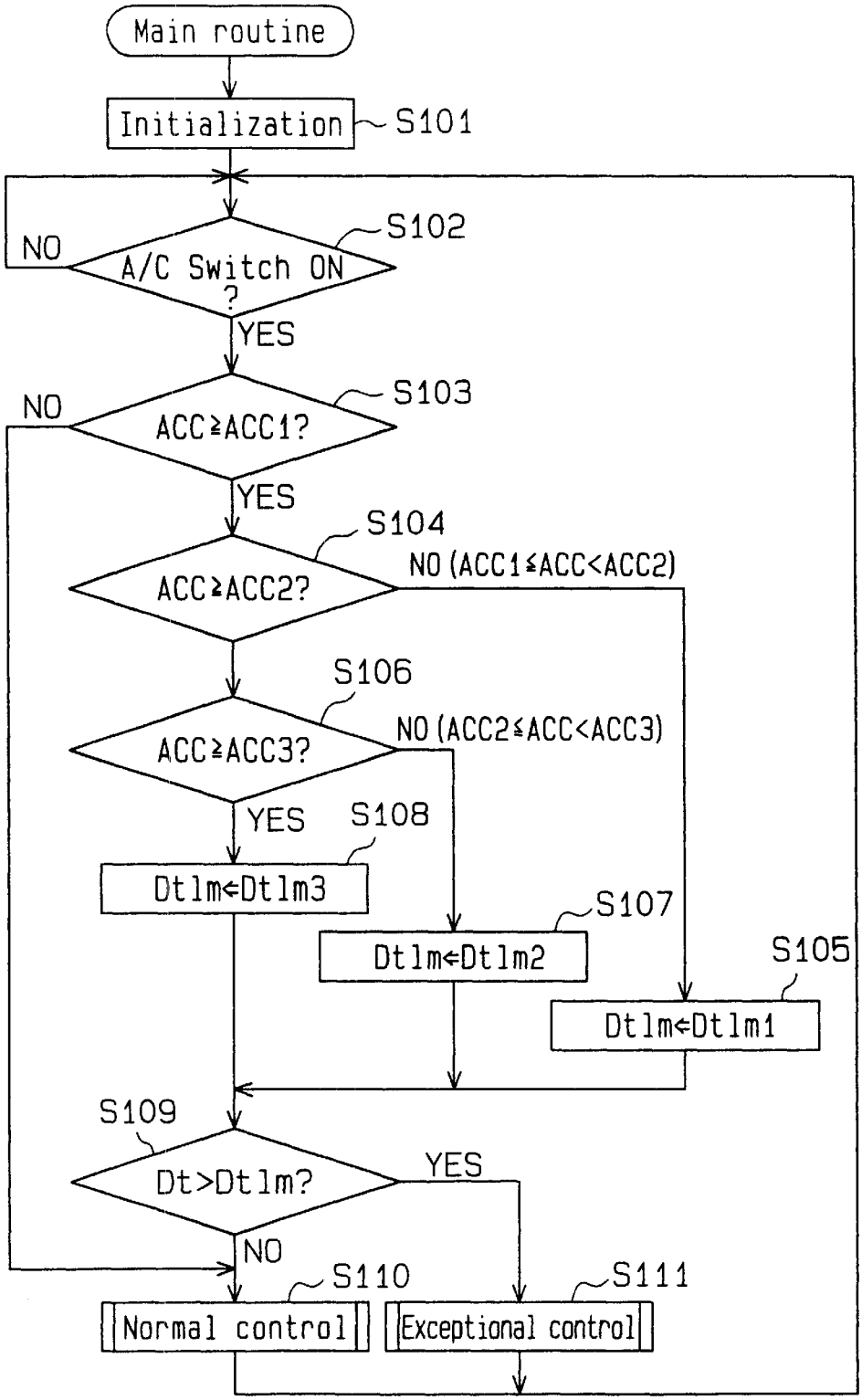
FIG. 5 is a flowchart showing a main routine for controlling a compressor displacement.

The flowchart of FIG. 5 shows the main routine for controlling the compressor displacement. When the vehicle ignition switch or the starting switch is turned on, the controller 81 starts processing. The controller 81 performs various initial settings in step S101. For example, the controller 81 assigns predetermined initial value to the duty ratio Dt of the voltage applied to the coil 75.

In step S102, the controller 81 waits until the air conditioner switch 83 is turned on. When the air conditioner switch 83 is turned on, the controller sets a limit value Dtlm of the duty ratio Dt in accordance with the load on the engine Eg in steps S103 to S108.

In step S103, the controller 81 judges whether the pedal depression degree detected by the pedal position sensor 86 is equal to or greater than a predetermined first value ACC1. If the outcome of step S103 is negative, the controller 81 judges that the pedal depression degree ACC is relatively small, or that there is no demand for quick acceleration. In this case, the compressor displacement need not be limited for decreasing the load on the engine Eg. Therefore, the controller 81 does not set the limit value Dtlm of the duty ratio Dt and moves to step S110.

If the outcome of step S103 is positive, the controller 81 judges that there is a demand for quick acceleration and sets the limit value Dtlm of the duty ratio Dt. The limit value Dtlm is set in accordance with the pedal depression degree ACC, or the degree of the required acceleration (engine load).

In step S104, the controller 81 judges whether the pedal depression degree ACC is equal to or greater than a predetermined second value ACC2. The second value ACC2 is greater than the first value ACC1. If the outcome of step S104 is negative, that is, if an inequality ACC1≦ACC<ACC2 is satisfied, the controller 81 judges that the required degree of acceleration or the engine load is relatively small and moves to step S105. In step S105, the controller 81 sets the limit value Dtlm to a predetermined first value Dtlm1 moves to step S109.

If the outcome of step S104 is positive, the controller 81 moves to step S106 and judges whether the pedal depression degree ACC is equal to or greater than a predetermined third value ACC3. The third value ACC is greater than the second value ACC2. If the outcome of step S106 is negative, that is, if an inequality ACC2≦ACC<ACC3 is satisfied, the controller 81 judges that the degree of the required quick acceleration is intermediate and moves to step S107. In step S107, the controller 81 sets the limit value Dtlm to a predetermined second value Dtlm2 and moves to step S109. The second value Dtlm2 is less than the first value Dtlm1.

If the outcome of step S106 is positive, the controller 81 judges that the degree of the required quick acceleration or the engine load is relatively great and moves to step S108. In step S108, the controller 81 sets the limit value Dtlm to a predetermined third value Dtlm3 and moves to step S109. The third value Dtlm3 is less than the second value Dtlm2 and is, for example, zero percent.

In step S109, the controller 81 judges whether the current duty ratio Dt is greater than the limit value Dtlm, which is set in accordance with the pedal depression degree ACC. In other words, the controller 81 judges whether the compressor displacement that corresponds to the current duty ratio Dt is greater than the compressor displacement that corresponds to the limit value Dtlm. The compressor displacement correlates with the compressor torque. If the outcome of step S109 is negative, the controller 81 judges that the compressor torque will not significantly increase the load on the engine Eg during the currently required quick acceleration. In step S110, the controller 81 executes a normal control procedure shown in FIG. 6.

If the outcome of step S109 is positive, the controller 81 judges that the compressor torque will increase the load on the engine Eg during the currently required quick acceleration and moves to step S111. In step S111, the controller 81 executes an exceptional control procedure shown in FIG. 7 for temporarily limiting the compressor displacement and the compressor torque.

Figure 6:
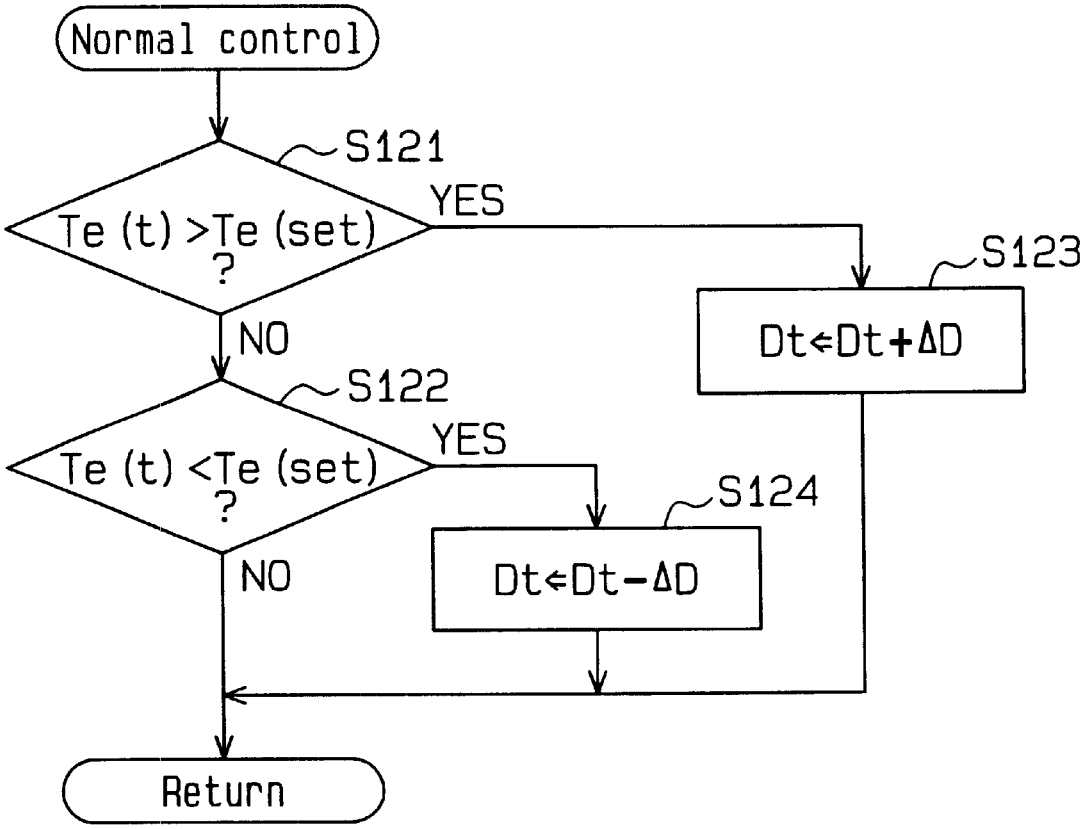
FIG. 6 is a flowchart showing a normal control procedure.

The normal control procedure of FIG. 6 will now be described. In step S121, the controller 81 judges whether the temperature Te(t), which is detected by the temperature sensor 84, is higher than a desired temperature Te(set), which is set by the temperature adjuster 85. If the outcome of step S121 is negative, the controller 81 moves to step S122. In step S122, the controller 81 judges whether the temperature Te(t) is lower than the desired temperature Te(set). If the outcome in step S122 is also negative, the controller 81 judges that the detected temperature Te(t) is equal to the desired temperature Te(set) and returns to the main routine of FIG. 5 without changing the current duty ratio Dt.

If the outcome of step S121 is positive, the controller 81 moves to step S123 for increasing the cooling performance of the refrigerant circuit. In step S123, the controller 81 adds a predetermined value ΔD to the current duty ratio Dt and sets the resultant as a new duty ratio Dt. The controller 81 sends the new duty ratio Dt to the drive circuit 82. Accordingly, the electromagnetic force F of the solenoid 52 is increased by an amount that corresponds to the value ΔD, which moves the rod 53 in the valve closing direction. As the rod 53 moves, the force f1 of the return spring 68 is increased. The axial position of the rod 53 is determined such that equation IV is satisfied.

As a result, the opening size of the control valve 46 is decreased and the crank pressure Pc is lowered. Thus, the inclination angle of the swash plate 18 and the compressor displacement are increased. An increase of the compressor displacement increases the flow rate of refrigerant in the refrigerant circuit and increases the cooling performance of the evaporator 38. Accordingly, the temperature Te(t) is lowered to the desired temperature Te(set) and the pressure difference (PdH−PdL) is increased.

If the outcome of S122 is positive, the controller 81 moves to step S124 for decreasing the cooling performance of the refrigerant circuit. In step S124, the controller 81 subtracts the predetermined value ΔD from the current duty ratio Dt and sets the resultant as a new duty ratio Dt. The controller 81 sends the new duty ratio Dt to the drive circuit 82. Accordingly, the electromagnetic force F of the solenoid 52 is decreased by an amount that corresponds to the value ΔD, which moves the rod 53 in the valve opening direction. As the rod 53 moves, the force f1 of the return spring 68 is decreased. The axial position of the rod 53 is determined such that equation IV is satisfied.

As a result, the opening size of the control valve 46 is increased and the crank pressure Pc is raised. Thus, the inclination angle of the swash plate 18 and the compressor displacement are decreased. A decrease of the compressor displacement decreases the flow rate of refrigerant in the refrigerant circuit and decreases the cooling performance of the evaporator 38. Accordingly, the temperature Te(t) is raised to the desired temperature Te(set) and the pressure difference (PdH−PdL) is decreased.

As described above, the duty ratio Dt is optimized in steps S123 and S124 such that the detected temperature Te(t) seeks the desired temperature Te(set).

The exceptional control procedure of FIG. 7 will now be described. In step S131, the controller 81 stores the current duty ratio Dt as a restoration target value DtR. In step S132, the controller 81 starts a timer.

In step S133, the controller 81 sets the duty ratio Dt to the limit value Dtlm, which was set in one of steps S105, S107 and S108 of the main routine shown in FIG. 5. Therefore, the duty ratio Dt is decreased to the limit value Dtlm. Accordingly, the electromagnetic force of the solenoid 52 is decreased, which increases the opening size of the control valve 46. As a result, the inclination angle of the swash plate 18 and the compressor displacement are decreased, which decreases the torque of the compressor and reduces the engine load.

In step S134, the controller 81 judges whether the elapsed period STM measured by the timer is more than a predetermined period ST. Until the measured period STM surpasses the predetermined period ST, the controller 81 maintains the duty ratio Dt at the limit value Dtlm. Therefore, the compressor displacement and torque are limited until the predetermined period ST elapses. The predetermined period ST starts when the displacement limiting control procedure is started. This permits the vehicle to be smoothly accelerated. Since acceleration is generally temporary, the period ST need not be long.

When the measured period STM surpasses the period ST, the controller 81 moves to step S135. In step S135, the controller 81 executes a duty ratio restoration control procedure. In this procedure, the duty ratio Dt is gradually restored to the restoration target value DtR over a certain period. Therefore, the inclination of the swash plate 18 is changed gradually, which prevents the shock of a rapid change. In the chart of step S135, the period from time t3 to time t4 represents a period from when the duty ratio Dt is set to the limit value Dtlm in step S131 to when the outcome of step S134 is judged to be positive. The duty ratio Dt is restored to the restoration target value DtR from the limit value Dtlm over the period from the time t4 to time t5. When the duty ratio Dt reaches the restoration target value DtR, the controller 81 moves to the main routine shown in FIG. 5.

This embodiment has the following advantages.

The control valve 46 does not directly control the suction pressure Ps, which is influenced by the thermal load on the evaporator 38. The control valve 46 directly controls the pressure difference (PdH−PdL) between the pressures at the pressure monitoring points P1, P2 in the refrigerant circuit for controlling the compressor displacement. Therefore, the compressor displacement is controlled regardless of the thermal load on the evaporator 38. During the exceptional control procedure, the voltage applied to the control valve 46 is limited, which quickly limits the compressor displacement. Accordingly, during the exceptional control procedure, the displacement is limited and the engine load is decreased. The vehicle therefore runs smoothly.

During the normal control procedure, the duty ratio Dt is adjusted based on the detected temperature Te(t) and the desired temperature Te(set), and the operating rod 53 operates depending on the pressure difference (PdH−PdL). That is, the control valve 46 not only operates based on external commands but also automatically operates in accordance with the pressure difference (PdH−PdL), which acts on the control valve 46. The control valve 46 therefore effectively controls the compressor displacement such that the actual temperature Te(t) seeks the target temperature Te(set) and maintains the target temperature Te(set) in a stable manner. Further, the control valve 46 quickly changes the compressor displacement when necessary.

The duty ratio Dt of the voltage applied to the solenoid 52, i.e., the electromagnetic force F of the solenoid 52, indicates the desired value of the pressure difference (PdH−PdL). The operating rod 53 operates according to the pressure difference (PdH−PdL) so that the pressure difference (PdH−PdL) is steered to the desired value. Thus, the intended displacement control is constantly and reliably realized. For example, when the compressor is operating at the limited displacement in the exceptional control procedure, the compressor can easily return to a normal displacement according to a desired recovery pattern, and such a recovery pattern is easily set to avoid shocks that may occur due to the displacement increase.

The pressures PdH and PdL at the pressure monitoring point P1 and P2 need not be detected by electric sensors, which simplifies the structure.

When the pedal depression degree ACC is less than the first value ACC1, there is no demand for quick acceleration. In this case, the limit value Dtlm of the duty ratio Dt is not set. Therefore, the refrigerant circuit exerts its full cooling performance for maintaining the compartment temperature at the desired level.

When the pedal depression degree ACC is more than the first value ACC1, there is a demand for quick acceleration. In this case, the duty ratio Dt is set to the limit value Dtlm. The exceptional control procedure is executed for limiting the compressor displacement and the compressor torque only when the duty ratio Dt, which is set in accordance with the required cooling performance of the refrigerant circuit, exceeds the limit value Dtlm. In other words, when there is a demand for quick acceleration, the exceptional control procedure is not executed if the current compressor torque does not significantly increase the load on the engine Eg. The compressor displacement is limited only when the compressor torque is judged to hinder quick acceleration. Thus, the cooling performance is less frequently decreased to a level that is lower than a required level.

The limit value Dtlm of the duty ratio Dt is set in accordance with the pedal depression degree ACC, or the degree of the need for quick acceleration (engine load). The smaller the degree of the need for quick acceleration, the greater the limit value Dtlm. Thus, compared to a case where the limit value Dtlm is constant, whether the exceptional control procedure needs to be executed is properly determined. Also, the exceptional control procedure is less frequently executed. Therefore, the occasions in which the cooling performance is lowered below a demanded level are minimized.

During the exceptional control procedure, the duty ratio Dt is set to the limit value Dtlm, which corresponds to the degree of the need for quick acceleration. If the degree of the need for quick acceleration is relatively small during the exceptional control procedure, the duty ratio Dt is not greatly decreased, which prevents the compressor displacement from being greatly decreased. Therefore, compared to a case where the compressor displacement is always minimized when the exceptional control procedure is executed, the compressor displacement is not limited more than required. During the exceptional control procedure, the cooling performance is not lowered by an excessive degree.

Accordingly, the vehicle is quickly accelerated without reducing the cooling performance by an excessive degree.

It should be apparent to those skilled in the art that the present invention may be embodied in many other specific forms without departing from the spirit or scope of the invention. Particularly, it should be understood that the invention may be embodied in the following forms.

The limit value Dtlm need not be varied in accordance with the pedal depression degree ACC. Instead, the limit value Dtlm may be constant.

In the routine of FIG. 5, the degree of the demanded quick acceleration, or the engine load, is judged to be in one of the three regions. However, the engine load may be determined to be in one of two regions or more than three regions.

Figure 7:
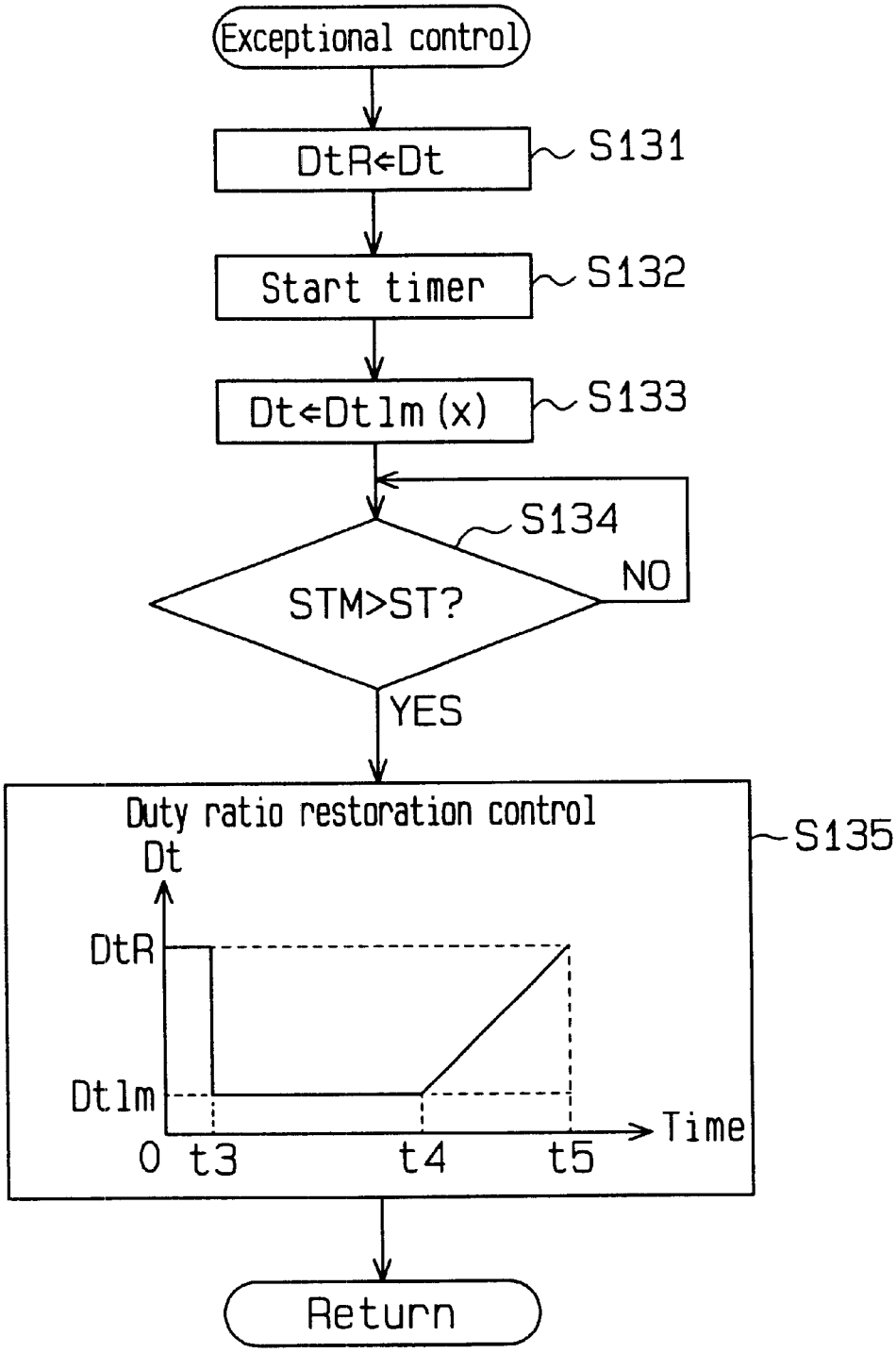
FIG. 7 is a flow chart showing an exceptional control procedure.
Figure 8:
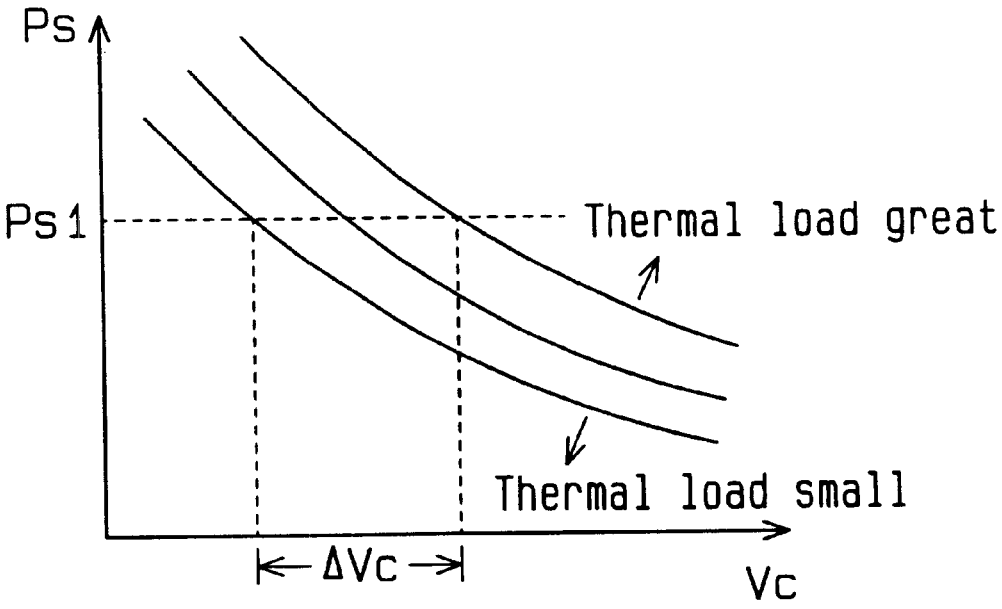
Fig.8 (Prior Art)
FIG. 8 is a graph showing the relationship between the suction pressure Ps and the displacement Vc of a prior art compressor.

In the duty ratio restoration control procedure shown in FIG. 7, the duty ratio Dt may be discretely increased to the restoration target value DtR.

In the duty ratio restoration control procedure shown in FIG. 7, the duty ratio Dt may be quickly increased from the limit value Dtlm to the restoration target value DtR if the difference between the limit value Dtlm and the restoration target value DtR is less than a predetermined value.

Instead of or in addition to the pedal depression degree ACC, at least one of the following parameters, which represent the engine load, may be used for judging the engine load. The parameters include, for example, the changing speed of the pedal depression degree ACC, the opening size of the throttle valve, the flow rate of air that is drawn into the engine Eg, the pressure of the air drawn into the engine Eg, the engine speed and the vehicle speed.

For example, the engine load may be judged based on the pedal depression degree ACC and the vehicle speed. In this case, the engine load is judged to be relatively great due to an uphill movement of the vehicle if the vehicle speed is low despite of a relatively great value of the pedal depression degree ACC. In this case, the routine similar to the routine of FIG. 5 is executed.

The devices for detecting external information that represents the required level of the cooling performance may include a solar radiation sensor and an external temperature sensor instead of or in addition to the temperature sensor 84 and the temperature adjuster 85.

The first pressure monitoring point P1 need not be located in the discharge chamber 23. The first pressure monitoring point P1 may be located at any position as long as the position is exposed to the discharge pressure Pd. In other words, the first pressure monitoring point P1 may be located anywhere in a high pressure zone of the refrigerant circuit, which includes the discharge chamber 23, the condenser 36 and the high pressure pipe 40. The second pressure monitoring point P2 may be located at any position that is downstream of the first pressure monitoring point P1 in the high pressure zone.

The first pressure monitoring point P1 may be located in a zone that is exposed to the suction pressure Ps (low pressure zone), and the second pressure monitoring point P2 may be located in a section of the low pressure zone that is downstream of the first pressure monitoring point P1. The low pressure zone refers to a section of the refrigerant circuit that includes the evaporator 38, the suction chamber 22 and the low pressure pipe 39.

The first pressure monitoring point P1 may be located in the high pressure zone, and the second pressure monitoring point P2 may be located in the low pressure zone.

The first pressure monitoring point P1 may be located in the high pressure zone, and the second pressure monitoring point P2 may be located in the crank chamber 15. Alternatively, the first pressure monitoring point P1 may be located in the crank chamber 15, and the second pressure monitoring point P2 may be located in the low pressure zone. The crank chamber 15 is an intermediate pressure zone, which is exposed to a pressure that is lower than the pressure of the high pressure zone and is higher than the pressure of the low pressure zone.

The pressure monitoring points P1, P2 may be at any two locations in the refrigerant circuit, which includes the compressor and the external circuit 35.

If the first pressure monitoring point P1 is located in the crank chamber 15 and the second pressure monitoring point P2 is located in the low pressure zone, the pressure difference (Pc−Ps) between the pressure monitoring points P1, P2 decreases as the compressor displacement is increased, unlike the embodiment of FIGS. 1 to 7. Thus, the limit value Dtlm of the duty ratio Dt is set as a lower limit value, not an upper limit value. When the duty ratio Dt, which represents the pressure difference (Pc−Ps), falls below the limit value Dtlm, the duty ratio Dt is increased to the limit value Dtlm.

The pressures PdH, PdL at the pressure monitoring points P1, P2 may be detected by electric pressure sensors, respectively, and the control valve 46 may be actuated in accordance with the difference between the detected pressures.

The control valve 46 may be located in the bleed passage 31 to regulate the flow rate of gas released from the crank chamber 15 to the suction chamber 22.

The control valve 46 may be designed to adjust the aperture size of the bleed passage 31 in addition to that of the supply passage 110.

The power transmission mechanism PT may include a clutch mechanism. In this case, if the pedal depression degree ACC is greater than the third determination value ACC3, the clutch mechanism may disconnect the compressor from the engine Eg.

The present invention can be embodied in a control valve of a wobble type variable displacement compressor.

The drive source of the vehicle need not be an internal combustion engine. The drive source may be an electric motor or a hybrid engine, which includes an electric motor and an internal combustion engine.

Therefore, the present examples and embodiments are to be considered as illustrative and not restrictive and the invention is not to be limited to the details given herein, but may be modified within the scope and equivalence of the appended claims.

What is claimed is:

1. A displacement control apparatus for a variable displacement compressor used in a refrigerant circuit of a vehicle air conditioner, wherein the compressor is driven by a drive source of a vehicle, the apparatus comprising:

a displacement control mechanism, which controls the displacement of the compressor based on the pressure difference between the pressures at two pressure monitoring points located in the refrigerant circuit, the pressure difference representing the displacement of the compressor;

a first device for detecting external information representing the required cooling performance of the refrigerant circuit;

a second device for detecting external information representing the load acting on the drive source; and a controller for determining a target value of the pressure difference based on the external information detected by the first device, wherein the displacement control mechanism controls the displacement of the compressor such that the pressure difference seeks the target value, wherein the controller judges whether to set a limit value of the pressure difference based on the external information detected by the second device, wherein, when the limit value is set and a compressor displacement that corresponds to the target value is greater than a compressor displacement that corresponds to the limit value, the controller uses the limit value as the target value of the pressure difference to limit the compressor displacement.

2. The displacement control apparatus according to claim 1, wherein the controller sets the limit value when the load on the drive source is equal to or greater than a predetermined level.

3. The displacement control apparatus according to claim 1, wherein the controller changes the limit value in accordance with the load acting on the drive source.

4. The displacement control apparatus according to claim 3, wherein the controller discretely changes the limit value in accordance with the load acting on the drive source.

5. The displacement control apparatus according to claim 1, wherein the controller maintains the target value of the pressure difference at the limit value for a predetermined period and then changes the target value to a target value that is determined based on the external information detected by the first device over a predetermined period.

6. The displacement control apparatus according to claim 1, wherein the compressor includes a crank chamber, an inclining drive plate located in the crank chamber and a piston, which is reciprocated by the drive plate, wherein the inclination angle of the drive plate changes in accordance with the pressure in the crank chamber, and the inclination angle of the drive plate determines the stroke of the piston and the compressor displacement, wherein the displacement control mechanism includes a control valve located in the compressor, and wherein the control valve operates depending on the pressure difference to adjust the pressure in the crank chamber.

7. The displacement control apparatus according to claim 6, wherein the control valve includes:

a valve body;

an actuator for urging the valve body, wherein the controller controls power supplied to the actuator such that the urging force of the actuator corresponds to the target value; and a pressure receiving body, wherein the pressure receiving body actuates the valve body in accordance with the pressure difference acting on the pressure receiving body such that the pressure difference seeks the target value.

8. The displacement control apparatus according to claim 1, wherein the first device detects external information related to a temperature.

9. The displacement control apparatus according to claim 8, wherein the first device includes a temperature sensor for detecting the temperature in the passenger compartment and a temperature adjuster for setting a target value of the compartment temperature, and wherein the controller determines the target value of the pressure difference based on the difference between the detected compartment temperature and the target temperature.

10. The displacement control apparatus according to claim 1, wherein the second device includes a pedal position sensor for detecting the depression degree of an acceleration pedal of the vehicle.

11. A displacement control apparatus for a variable displacement compressor used in a refrigerant circuit of a vehicle air conditioner, wherein the compressor is driven by a drive source of a vehicle, the apparatus comprising:

a displacement control mechanism, which controls the displacement of the compressor based on the pressure difference between the pressures at two pressure monitoring points located in the refrigerant circuit, the pressure difference representing the displacement of the compressor;

a first device for detecting external information representing the required cooling performance of the refrigerant circuit;

a second device for detecting information representing the load acting on the external drive source;

a determining means for determining a target value of the pressure difference in accordance with the external information detected by the first device, wherein the displacement control mechanism controls the displacement of the compressor such that the pressure difference seeks the target value;

a judging means for judging whether to set a limit value of the pressure difference based on the external information detected by the second device, and a means for using the limit value as the target value of the pressure difference to limit the compressor displacement when the limit value is set and a compressor displacement that corresponds to the target value is greater than a compressor displacement that corresponds to the limit value.

12. A method for controlling the displacement of a variable displacement compressor used in a refrigerant circuit of a vehicle air conditioner, wherein the compressor is driven by a drive source of a vehicle, the method comprising:

determining a target value of the pressure difference between the pressures at two pressure monitoring points located in the refrigerant circuit based on external information that represents the required cooling performance of the refrigerant circuit, the pressure difference representing the displacement of the compressor;

controlling the compressor displacement such that the pressure difference seeks the target value;

judging whether to set a limit value of the pressure difference based on external information that represents the load acting on the drive source; and using the limit value as the target value of the pressure difference when the limit value is set and when a compressor displacement that corresponds to the target value is greater than a compressor displacement that corresponds to the limit value.

13. The method according to claim 12, wherein, when the load acting on the drive source is equal to or greater than a predetermined level, the limit value is set.

14. The method according to claim 12, further comprising:

changing the limit value in accordance with the load acting on the drive source.

15. The method according to claim 14, wherein the limit value is discretely changed in accordance with the load acting on the drive source.

16. The method according to claim 12, further comprising:

maintaining the target value of the pressure difference at the limit value for a predetermined period; and changing the target value to a target value that is determined based on the external information representing the required cooling performance of the refrigerant circuit over a predetermined period.

* * * * *